US005465764A

United States Patent [19]

Eschmann et al.

[11] Patent Number: 5,465,764

[45] Date of Patent: Nov. 14, 1995

[54] PAPERMAKING DRYER FABRIC WITH GROUPS OF ABUTTING MACHINE DIRECTION THREADS

[75] Inventors: Sylvester Eschmann, Mönchengladbach; Martin Hüser; Walter Halterbeck, both of Düren, all of Germany

[73] Assignee: Thomas Josef Heimbach GmbH & Co., Duren, Germany

[21] Appl. No.: 188,330

[22] Filed: Jan. 25, 1994

[30] Foreign Application Priority Data

Jan. 26, 1993 [DE] Germany ..... 43 02 031.3

[51] Int. Cl.[6] ..... D03D 1/00

[52] U.S. Cl. ..... 139/383 A; 139/425 A; 428/225

[58] Field of Search ..... 139/383 A, 425 A; 428/225

[56] References Cited

U.S. PATENT DOCUMENTS

| | | | |
|---|---|---|---|
| 2,168,928 | 9/1939 | Barrell . | |
| 2,172,430 | 9/1939 | Barrell | 139/383 A |
| 2,180,054 | 11/1939 | Hindle et al. . | |
| 3,167,281 | 1/1965 | Hill . | |
| 4,611,639 | 9/1986 | Bugge . | |
| 4,636,426 | 1/1987 | Fleischer . | |
| 4,654,052 | 1/1986 | Borel | 139/383 A X |
| 4,729,412 | 3/1988 | Bugge . | |
| 4,789,009 | 12/1988 | Troughton | 139/383 A |
| 4,815,499 | 3/1989 | Johnson | 139/383 A |
| 4,934,414 | 6/1990 | Borel | 139/383 A |
| 5,025,839 | 6/1991 | Wright | 139/383 A |
| 5,092,373 | 3/1992 | Lee . | |
| 5,116,478 | 5/1992 | Tate et al. | 139/383 A |
| 5,117,865 | 6/1992 | Lee . | |

FOREIGN PATENT DOCUMENTS

| | | | |
|---|---|---|---|
| 530871 | 8/1954 | Belgium | 139/425 A |
| 0044053 | 1/1981 | European Pat. Off. . | |
| 0232708 | 8/1987 | European Pat. Off. . | |
| 0325167 | 7/1989 | European Pat. Off. . | |
| 454092 | 12/1927 | Germany | 139/383 A |
| 680111 | 7/1939 | Germany . | |
| 1267960 | 1/1968 | Germany . | |
| 2907488 | 8/1980 | Germany | 139/425 A |
| 2847327 | 2/1984 | Germany . | |
| 3146385 | 10/1985 | Germany . | |
| 3329740 | 7/1986 | Germany . | |
| 9101776 | 3/1991 | WIPO . | |

*Primary Examiner*—Andy Falik
*Attorney, Agent, or Firm*—Joseph W. Berenato, III

[57] ABSTRACT

A dryer screen has a paper side and a machine side. A plurality of machine direction threads extend in the direction of movement of the screen. The machine direction threads are arrayed in first and second groups. The threads of the groups are bound to the screen through different binding pattern repeats. A plurality of cross threads extend generally transverse to the machine direction threads. The threads of the first group are arrayed in first and second subgroups offset with respect to the direction of movement of the screen. Each subgroup comprises at least two abutting contiguous machine direction threads having a binding pattern repeat floating on the paper side over a predetermined plurality of cross threads.

22 Claims, 1 Drawing Sheet

PAPERMAKING DRYER FABRIC WITH GROUPS OF ABUTTING MACHINE DIRECTION THREADS

FIELD OF THE INVENTION

This invention relates to a dryer screen with machine direction threads that extend in the machine movement direction and cross machine direction threads that extend transversely thereto and consist of synthetic material, with one first group of machine direction threads floating on the paper side over several cross machine direction threads and a second group of machine direction threads being present and binding in a manner different from that of the first group of machine direction threads.

Dryer screens are fabrics consisting of synthetic threads with machine direction threads that extend in the machine movement direction and with cross machine direction threads that extend tranversely thereto. They are inserted in the dry sector of a paper machine, and there they guide the paper web over the hot dry cylinders. Here the essential thing is that the dryer screens provide for a good heat transfer and that condensate formation is prevented. An effort has therefore been made to shape the dryer screens as thin as possible and to make large contact surfaces available.

Many fabric designs are known for dryer screens. Reference is made here, merely by way of example, to PCT Application WO 91/19044 and to the state of the art described there. This publication discloses paper machine fabrics where a first group of machine direction threads floats on the paper side over several cross machine direction threads, the machine direction threads here being made in the form of flat monofilaments. This group of machine direction threads runs above a second group of machine direction threads that can also be made in the form of flat monofilaments.

The known dryer screen does, of course, have a good contact surface due to the use of very wide flat monofilaments, especially for the machine direction threads of the first group. But these threads impair the flexibility of the dryer screen. Besides, the very wide flat monofilaments are special threads that are not easy to process and that are expensive.

SUMMARY OF THE INVENTION

The purpose of the invention, therefore, is to design a dryer screen of the kind mentioned initially so that good flexibility will be attained in spite of the large contact surface on the paper side.

According to the invention, this problem is solved in that at least two neighboring machine direction threads of the first group in each case form subgroups of machine direction threads that run in an equally binding manner, at least on the paper side, and that the machine direction threads of one subgroup rest next to each other, side by side. Preferably, the machine direction threads of one subgroup should also run in an equally binding manner for the rest. The term "equally binding" means the kind of course where the particular machine direction threads are tied up next to each other identically into the fabric.

According to the invention, in other words, the two contact surfaces are generated with the help of several machine direction threads that are combined to form subgroups with an identically binding course. For this purpose, one can use standard machine direction threads that are preferably made in the form of flat monofilaments with a cross-section ratio of 1.2:1 to 3:1. The flexibility of the dryer screen is not impaired because the machine direction threads, in spite of their combination into subgroups and their mutual contact, are movable among each other.

By way of a further feature of the invention, it is provided that, looking at it from the paper side, a machine direction thread of the second group runs underneath two neighboring machine direction threads of a subgroup. Here it is particularly preferred that no machine direction threads of the second group run between two subgroups of machine direction threads of the first group. When each subgroup consists only of two machine direction threads, then only one machine direction thread of the second group goes with two machine direction threads of the first group. On the one hand, this achieves a concentration of the machine direction threads on the paper side to attain a big contact surface; on the other hand, the dryer screen is comparatively open on the machine side and that makes for a good steam passage.

As a further feature of the invention, it is provided that the machine direction threads of the second group tie up on the paper side only with those cross machine direction threads over which float the machine direction threads of a subgroup, said threads running above this machine direction thread of the second group. In this way, one can avoid a crossover of the machine direction threads of the first and the second group. Corresponding features are also provided in a practical fashion on the underside or the machine side of the dryer screen in that the machine direction threads of the second group float on the machine side over those cross machine direction threads that tie up on the machine side with the machine direction threads of one subgroup, said threads running above the particular machine direction thread of the second group.

The machine direction threads of the first group should, on the paper side, float at least over three cross machine direction threads before they tie up anew. Floating, however, can also run over up to nine cross machine direction threads. On the machine side, the machine direction threads of the first group should tie up only with one cross machine direction thread. A corresponding feature is also provided for the machine direction threads of the second group where one gets a mirror-image course to the machine direction threads of the first group.

According to yet another feature of the invention, it is provided that the cross machine direction threads are made as open, hollow monofilaments such as they are known, for example, from U.S. Pat. No. 4,251,588. Here it is possible to make either all or only a part of the cross machine direction threads in the form of hollow monofilaments. In the latter case, the other part of the cross machine direction threads should then be made as massive monofilaments so that the hollow monofilaments then should alternate with the massive monofilaments, specifically and preferably, always one hollow monofilament with a massive monofilament. To attain a dryer screen that would be as thin as possible, the hollow monofilaments can then be made flattened, using a heat setting procedure.

Another feature of the invention consists of the fact that cross machine direction threads with a larger diameter alternate with cross machine direction threads that have a comparatively smaller diameter, specifically and preferably, in such a way that one cross machine direction thread with a larger diameter will always alternate with a cross machine direction thread having a smaller diameter.

The machine direction threads of a subgroup are in a practical fashion staggered with respect to the neighboring machine direction threads of a subgroup, in the machine movement direction, as far as their tie-up is concerned. Furthermore, the machine direction threads of the first group should have an identical cross-section shape and surface.

Although the dryer screen can also be made in the form of several layers, an effort is to be made to fashion this as a single-layer dryer screen to keep the thickness of the dryer screen as small as possible.

A dryer screen, according to the invention, can be made in a simple manner in that, for the weaving process, one uses shrinkable cross machine direction threads, and the dryer screen is heat-treated after the weaving process so that the particular identically binding, machine direction threads of one subgroup will come to abut, side by side. It is known that synthetic threads, such as, for example, polyester threads or the like, are subject to shrinkage when impacted with heat. The shrinkability here is used in a specifically determined fashion to place the machine direction threads of one subgroup against each other, and also to place the machine direction threads of two neighboring subgroups against each other, which makes for a large surface and practically uninterrupted contact surfaces.

DESCRIPTION OF THE DRAWINGS

The drawing illustrates the invention with the help of a practical example in greater detail.

DESCRIPTION OF THE INVENTION

Figure 1:
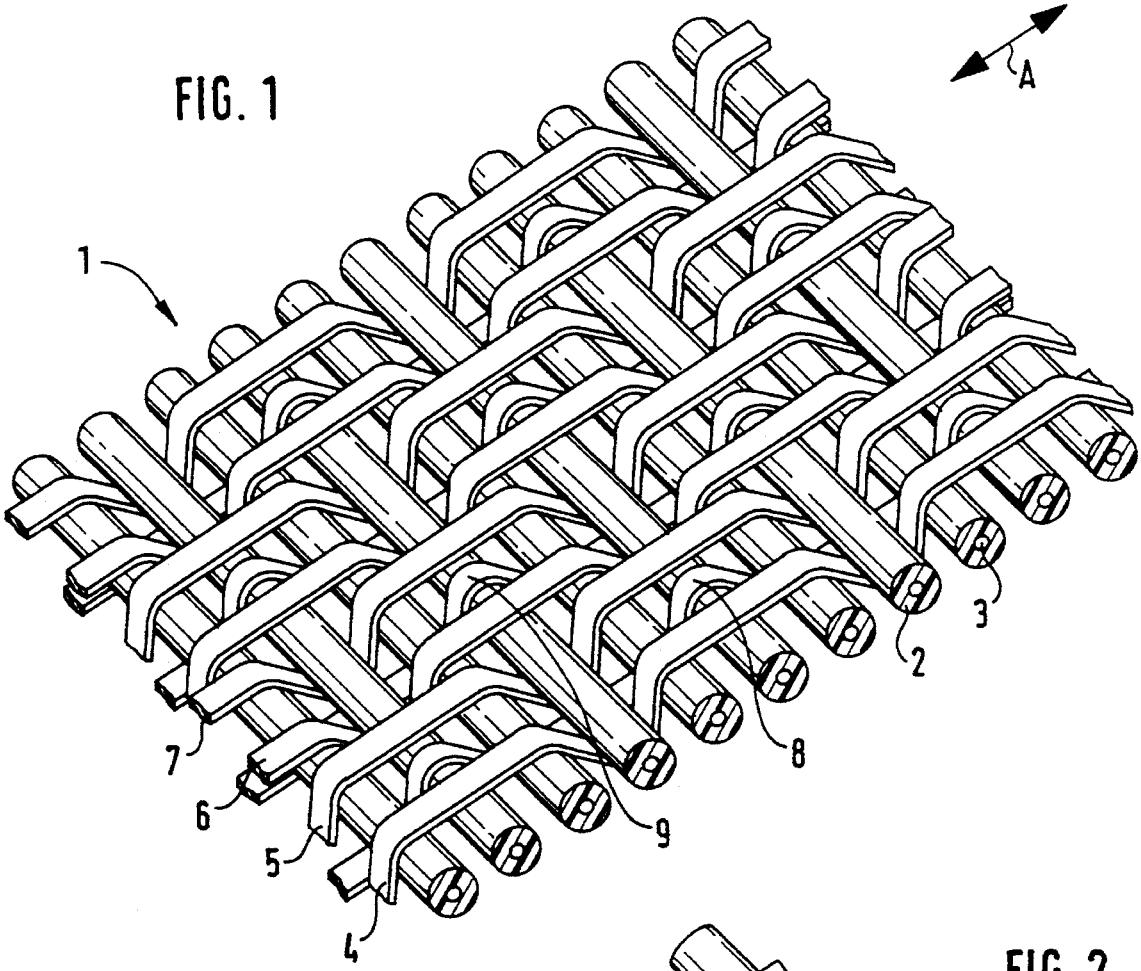
FIG. 1 is a fragmentary dryer screen according to the invention in perspective view, on its paper side, after the weaving process and prior to the shrinkage process.

Dryer screen (1), illustrated in FIG. 1, is made as a single-layer fabric and has a machine movement direction that runs along arrow A. Round cross machine direction threads —labeled (2), by way of example—run tranversely with respect to that machine movement direction A. These round cross machine direction threads are made in the form of hollow monofilaments, in other words, in the untreated state, they reveal cavities, labeled (3), by way of example. Cross machine direction threads (2) consist of a synthetic material, for example, polyester, that is highly shrinkable when heat is applied.

Machine direction threads tie up with cross machine direction threads (2) in machine movement direction A, and those machine direction threads are made of flat monofilaments with a rectangular cross-section. A first group of machine direction threads— labeled (4, 5, 6, 7), by way of example—in each case floats over three cross machine direction threads on the paper side, before the machine direction threads (4, 5, 6, 7) tie up with one cross machine direction thread (2), underneath, on the machine side. Here, two adjacent machine direction threads (4, 5,) or (6, 7) each time run in an identically binding fashion, in other words, they run identically and always parallel to each other. Two machine direction threads (4, 5) or (6, 7) at a time thus form subgroups in the first group of machine direction threads (4, 5, 6, 7), with the subgroups running next to each other, although staggered in machine movement direction A by two cross machine direction threads (2), each time.

Between two machine direction threads (4, 5) or (6, 7), forming a subgroup, there runs each time an additional machine direction thread (8, 9), and together they form a second group of machine direction threads. They run in mirror-image fashion with respect to the machine direction threads (4, 5) or (6, 7) of the first group, that is to say, in each case they tie up only with one cross machine direction thread (2) on the paper side and they then float on the machine side over three cross machine direction threads (2). Machine direction threads (8, 9) of the second group here, on the paper side, tie up only with those cross machine direction threads (2) over which float the machine direction threads (4, 5) or (6, 7) of the pertinent subgroup. Two machine direction threads (8, 9) of the second group, that run next to each other, are likewise staggered by two cross machine direction threads (2) in machine movement direction A, as regards to their tieup.

Figure 2:
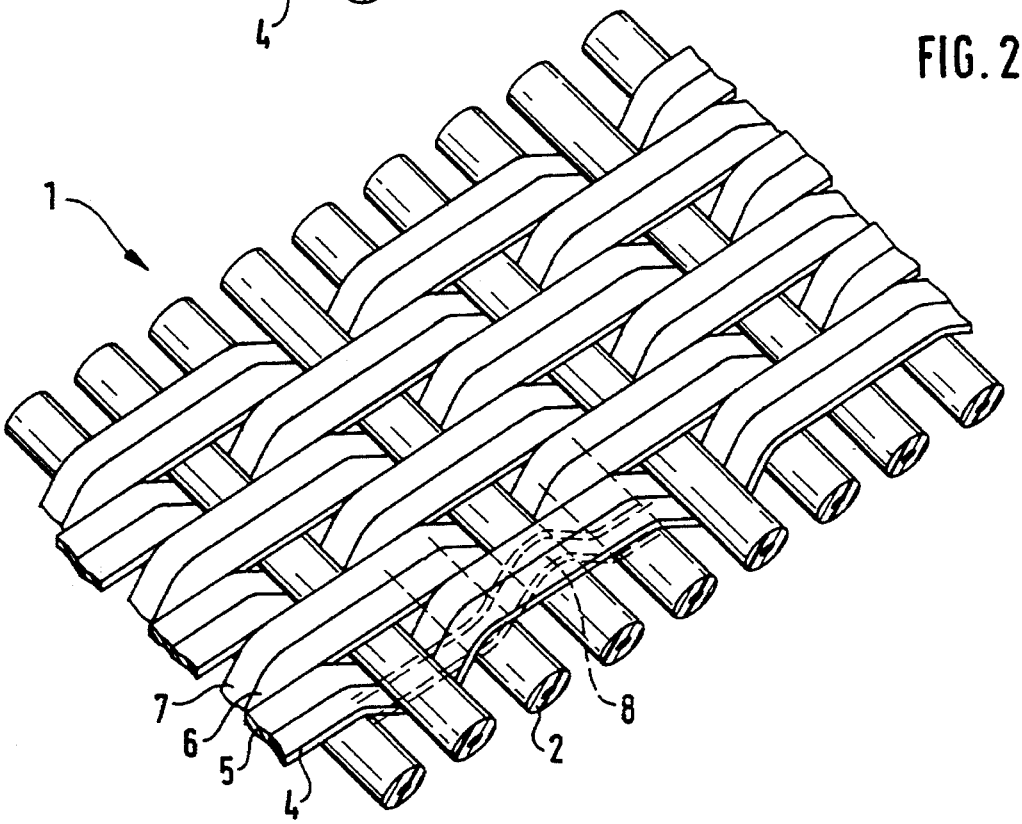
FIG. 2 is a fragmentary dryer screen according to FIG. 1 after the shrinking process, in the identical view.

FIG. 1 shows the condition of the dryer screen (1) after the weaving process. Machine direction threads (4, 5) or (6, 7) of a subgroup are then at an interval from each other that is somewhat greater than the width of the machine direction threads (8, 9) of the second group. The dryer screen thus made (1) is subjected to heat treatment at temperatures at which the cross machine direction threads (2) shrink rather considerably. As a result, machine direction threads (4, 5) or (6, 7) come to abut and, in the process, they are shoved along the paper side over the machine direction threads (8, 9) of the second group and on the machine side between the particular cross machine direction threads (2) and the particular machine direction threads (8, 9) that float there. The neighboring machine direction threads (5, 6) of the two subgroups also come to rest against each other then. In this way, one gets the fabric picture according to FIG. 2 that is characterized by large contact surfaces on the paper side.

The dryer screen (1) is then subjected to a heat setting treatment as a result of which the cross machine direction threads (2) are pressed flat so that the insides of the cavities (1) come to abut, in other words, that there will no longer be any cavities (3). This generates a very thin dryer screen (1) with favorable heat transfer properties.

I claim:

1. A dryer screen having a paper side and a machine side comprising:

a) a plurality of machine direction threads extending in the machine direction of the screen, said machine direction threads arrayed in first and second groups and the threads of said groups are bound to the screen through different binding pattern repeats;

b) a plurality of cross threads extend generally transverse to said machine direction threads;

c) the threads of said first group are arrayed in first and second subgroups offset with respect to the machine direction of the screen, and each subgroup comprises at least two abutting contiguous machine direction threads having a binding pattern repeat floating on the paper side over a predetermined plurality of cross threads; and d) the machine direction threads of said second group each having a portion interposed between the threads of one of said first and second subgroups and a cross thread.

2. The screen of claim 1, wherein:

a) the binding pattern repeats of said first and second subgroups are the same.

3. The screen of claim 2, wherein:

a) the predetermined number of cross threads over which the binding pattern repeats of said first and second subgroups float is from 3 to 9.

4. The screen of claim 2, wherein:

a) the binding pattern repeat of the machine direction threads of said second group is a mirror image of the binding pattern repeat of the machine direction threads of said first group.

5. The screen of claim 2, wherein:

a) no machine direction threads of said second group run between the threads of said first and second subgroups.

6. The screen of claim 1, wherein:

a) the machine direction threads of said second group bind to the screen on the paper side only with those cross threads over which the threads of said first and second subgroups float.

7. The screen of claim 1, wherein:

a) the machine direction threads of said second group float on the machine side over the cross threads which bind the machine direction threads of said first and second subgroups to the screen.

8. The screen of claim 1, wherein:

a) the machine direction threads of said first group bind to the screen on the machine side to only one cross thread.

9. The screen of claim 1, wherein:

a) the binding pattern repeat of the machine direction threads of said second group floats on the machine side of the screen over from 3 to 9 cross threads.

10. The screen of claim 9, wherein:

a) the binding pattern repeat of the machine direction threads of said second group on the paper side of the screen binds only to one cross thread.

11. The screen of claim 9, wherein:

a) the binding pattern repeat of the machine direction threads of said first group is a mirror-image of the binding pattern repeat of the machine direction threads of said second group.

12. The screen of claim 1, wherein:

a) said cross threads are comprised of a shrinkable synthetic material.

13. The screen of claim 12, wherein:

a) said material is polyester.

14. The screen of claim 12, wherein:

a) said cross threads are open hollow monofilaments.

15. The screen of claim 12, wherein:

a) said cross threads are open hollow monofilaments alternating with massive monofilaments.

16. The screen of claim 15, wherein:

a) the open hollow monofilaments are flattened.

17. The screen of claim 1, wherein:

a) cross threads having a first diameter alternate with cross threads having a second diameter, said second diameter being less than said first diameter.

18. The screen of claim 1, wherein:

a) the machine direction threads of said first group are flat monofilaments.

19. The screen of claim 18, wherein:

a) said flat monofilaments have a cross-section ratio of 1.2:1 to 3:1.

20. The screen of claim 19, wherein:

a) the machine direction threads of said first group have a common shape.

21. The screen of claim 1, wherein:

a) the machine direction threads of said first and second group are bound to the cross threads in a single layer.

22. A dryer screen having a paper side and a machine side, comprising:

a) a plurality of flat machine direction threads extending in the machine direction of the screen, said machine direction threads arrayed in first and second groups and the threads of said groups are bound to the screen through different binding pattern repeats;

b) a plurality of heat shrinkable cross threads extend generally transverse to said machine direction threads;

c) the threads of said first group are arrayed in first and second subgroups offset in the machine direction of the screen, and each subgroup comprises at least two abutting contiguous machine direction threads having a binding pattern repeat floating on the paper side over a predetermined plurality of cross threads; and d) a portion of each thread of said second group is interposed between the threads of one of said first and second subgroups and a cross thread.

* * * * *